US005396761A

United States Patent [19]

Woltmann et al.

[11] Patent Number: 5,396,761

[45] Date of Patent: Mar. 14, 1995

[54] GAS TURBINE ENGINE IGNITION FLAMEHOLDER WITH INTERNAL IMPINGEMENT COOLING

[75] Inventors: Ivan E. Woltmann, West Chester, Ohio; Jeffrey C. Mayer, Swampscott; John A. Manteiga, North Andover, both of Mass.

[73] Assignee: General Electric Company, Cincinnati, Ohio

[21] Appl. No.: 233,101

[22] Filed: Apr. 25, 1994

[51] Int. Cl.[6] ..... F02K 3/10

[52] U.S. Cl. ..... 60/39.827; 60/261; 60/749

[58] Field of Search ..... 60/39.32, 39.827, 39.83, 60/261, 262, 266, 737, 738, 740, 749, 754

[56] References Cited

U.S. PATENT DOCUMENTS

| | | | |
|---|---|---|---|
| 2,702,452 | 2/1955 | Taylor, Jr. | 60/749 |
| 2,780,061 | 2/1957 | Clarke et al. | 60/740 |
| 2,887,845 | 5/1959 | Hagen | 60/261 |
| 3,054,259 | 9/1962 | Arthur et al. | 60/749 |
| 3,487,636 | 1/1970 | Vdoviak et al. | 60/39.827 |
| 3,698,186 | 10/1972 | Beane et al. | 60/749 |
| 3,701,255 | 10/1972 | Markowski . | |
| 3,800,530 | 4/1974 | Nash | 60/261 |
| 4,064,691 | 12/1977 | Nash | 60/266 |
| 4,099,373 | 7/1978 | Griffin, Jr. et al. | 60/39.827 |
| 4,121,419 | 10/1978 | Kuznetsov et al. | 60/39.827 |
| 4,215,979 | 8/1980 | Morishita | 60/39.827 |
| 4,490,973 | 1/1985 | Kinsey | 60/261 |
| 4,798,048 | 1/1989 | Clements | 60/261 |
| 4,815,283 | 3/1989 | Eldredge et al. | 60/261 |
| 4,901,527 | 2/1990 | Nash et al. | 60/261 |
| 5,020,318 | 6/1991 | Vdoviak | 60/261 |
| 5,076,062 | 12/1991 | Abreu | 60/749 |
| 5,085,040 | 2/1992 | Tilston . | |
| 5,297,390 | 3/1994 | Sood | 60/740 |

OTHER PUBLICATIONS

Gopolan et al, "Integrated Approach to the F414 Afterburner," Winter 1994, pp.: Cover, 3, 12–15, and back, *The Leading Edge* (GE).

*Primary Examiner*—Timothy S. Thorpe

*Attorney, Agent, or Firm*—Jerome C. Squillaro; David L. Narciso

[57] ABSTRACT

A cooled ignition flameholder assembly includes a first heat shield having first and second spaced apart chambers. A fuel spraybar is disposed inside the first chamber, and a hollow baffle is disposed inside the second chamber. A second heat shield is joined to the first heat shield for closing the second chamber with the baffle therein. The baffle includes an inlet for receiving cooling air which is discharged through a plurality of outlet holes for impingement cooling the first and second heat shields. An ignition bulb is disposed adjacent to the second chamber and receives an igniter tip and a fuel injector tip for initiating combustion.

10 Claims, 6 Drawing Sheets

GAS TURBINE ENGINE IGNITION FLAMEHOLDER WITH INTERNAL IMPINGEMENT COOLING

The U.S. Government has rights in this invention in accordance with Contract No. N00019-91-C-0114 awarded by the Department of the Navy.

The present application is related to concurrently filed U.S. patent application Ser. No. 08/233,104, filed Apr. 25, 1994, entitled "Cooled Flameholder Assembly."

The present invention relates generally to gas turbine engines, and, more specifically, to a flameholder assembly in an augmenter or afterburner thereof.

BACKGROUND OF THE INVENTION

In high performance, military aircraft gas turbine engines, an afterburner or augmenter is disposed downstream of a core engine for providing additional thrust when desired. The augmenter includes an outer casing, a combustion liner and a plurality of circumferentially spaced apart fuel spraybars for injecting additional fuel when desired for augmenting thrust. Since the core gases from the core engine are typically below autoignition temperature, flameholders are typically required in the augmenter to provide stable regions downstream of the fuel spraybars for ensuring effective combustion of the injected fuel without blowout.

Although the augmenter environment is substantially hot due to the combustion process when the augmenter is in operation, the flameholders are typically uncooled and therefore have a limited useful life. Cooled flameholders are known in the art for improving useful life of the flameholders. However, the introduction of a cooling fluid in the hot environment of the augmenter necessarily creates substantial differences in temperature between the relatively cold and hot components of the flameholder. Flameholder designs having integral components subject to large differences in temperature from hot to cold are subject to low cycle fatigue therefrom which again limits the useful life of the flameholder assembly.

In order to initiate augmenter operation, a suitable ignition system therefor is required. Typical augmenter ignition systems are relatively large which undesirably increases weight and complexity. They include a fuel injector and an igniter disposed in a sheltered zone for ensuring stable ignition of the fuel/air mixture within the zone. The components are typically uncooled and therefore are subject to varying differential operating temperatures which effect low cycle fatigue thusly limiting the useful life of the ignition system. Furthermore, the ignition system is typically different in configuration then the radial and/or circumferential flameholders typically used in an augmenter and therefore has a single function of initiating combustion.

As the performance of an augmented aircraft engine increases, the temperature of the core discharge gases which are channeled to the augmenter also increase, and are therefore limited by the ability of the flameholder and ignition system to withstand such increased inlet temperatures without an undesirable useful life. Without suitable cooling of the flameholders and ignition system, a suitable useful life thereof is not attainable for such higher inlet gas temperatures. An improved, cooled flameholder assembly is disclosed and claimed in the application referenced above in the cross reference section which provides cooling for a radial flameholder assembly using relatively cold cooling air, with the different components of the assembly being suitably mounted to allow differential thermal expansion between the components without restraint for reducing low cycle fatigue. A complementary, cooled ignition system is the subject of the present invention.

SUMMARY OF THE INVENTION

A cooled ignition flameholder includes a first heat shield having first and second spaced apart chambers. A fuel spraybar is disposed inside the first chamber, and a hollow baffle is disposed inside the second chamber. A second heat shield is joined to the first heat shield for closing the second chamber with the baffle therein. The baffle includes an inlet for receiving cooling air which is discharged through a plurality of outlet holes for impingement cooling the first and second heat shields. An ignition bulb is disposed adjacent to the second chamber and receives an igniter tip and a fuel injector tip for initiating combustion.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
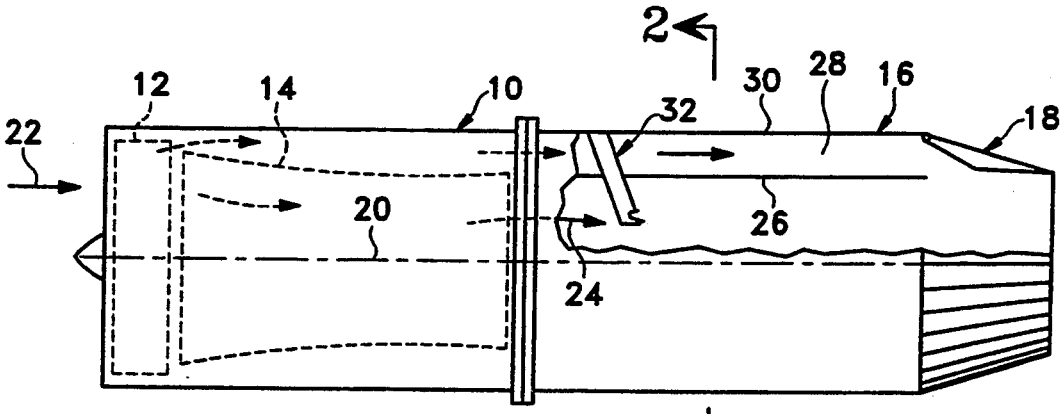
FIG. 1 is a schematic representation of an exemplary aircraft gas turbine engine having an augmenter with a cooled ignition flameholder assembly in accordance with one embodiment of the present invention.

Illustrated schematically in FIG. 1 is an exemplary aircraft gas turbine engine 10 having a conventional fan 12 powered by a conventional turbine core engine 14, an afterburner or augmenter 16 disposed downstream therefrom, and a conventional variable area exhaust nozzle 18 disposed downstream therefrom, all being disposed axisymmetrically around a longitudinal or axial centerline axis 20.

During operation, ambient air 22 enters the fan 12 and a portion thereof is channeled through the core engine 14 wherein it is compressed, mixed with fuel, and ignited for generating combustion gases which power one or more turbine stages for rotating the fan 12. The spent combustion gases are discharged from the core engine as core gases 24 and flow downstream through a conventional augmenter combustion liner 26 of the augmenter 16, which are in turn discharged through the nozzle 18. A portion of the ambient air 22 bypasses the core engine 14 and flows axially downstream in a bypass duct 28 defined between the augmenter liner 26 and an annular outer casing 30 disposed radially outwardly thereof. The air 22 is used to conventionally cool the augmenter liner 26 which has a plurality of conventional film cooling holes therein (not shown).

Figure 2:
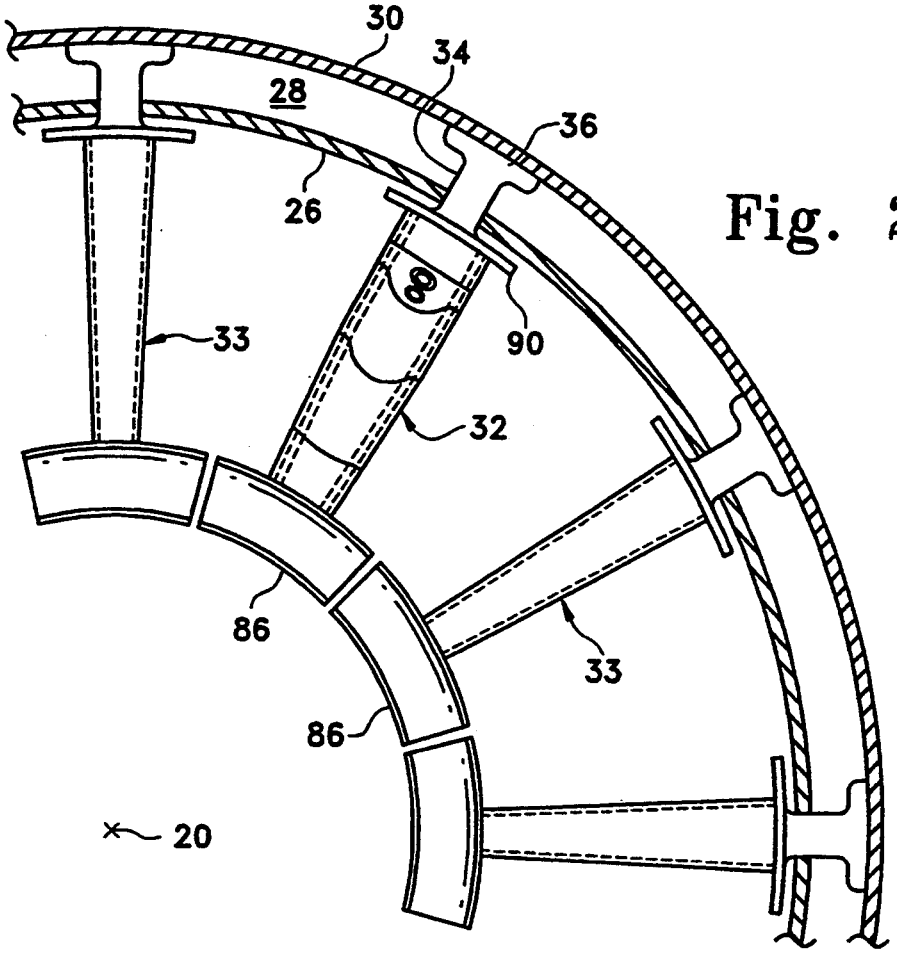
FIG. 2 is a quarter section view of the ignition flameholder disposed circumferentially between adjacent ones of complementary cooled flameholders illustrated in FIG. 1 and taken along line 2—2.

A cooled ignition flameholder assembly 32 in accordance with one embodiment of the present invention extends from the outer casing 30 and through the augmenter liner 26 at an upstream end thereof. FIG. 2 illustrates an exemplary embodiment of the ignition flameholder 32 which is disposed circumferentially between adjacent complementary cooled radial flameholders 33 around the centerline axis 20 for collectively forming a complete annular and axisymmetrical flameholder structure.

The cooled flameholders 33 are described in more detail in the cross referenced application identified above, with the ignition flameholder 32 described hereinbelow being closely related thereto in structure and function for providing ordinary flameholding capability with air cooled components, but additionally providing an enlarged sheltered zone and additional components for initiating combustion.

Figure 3:
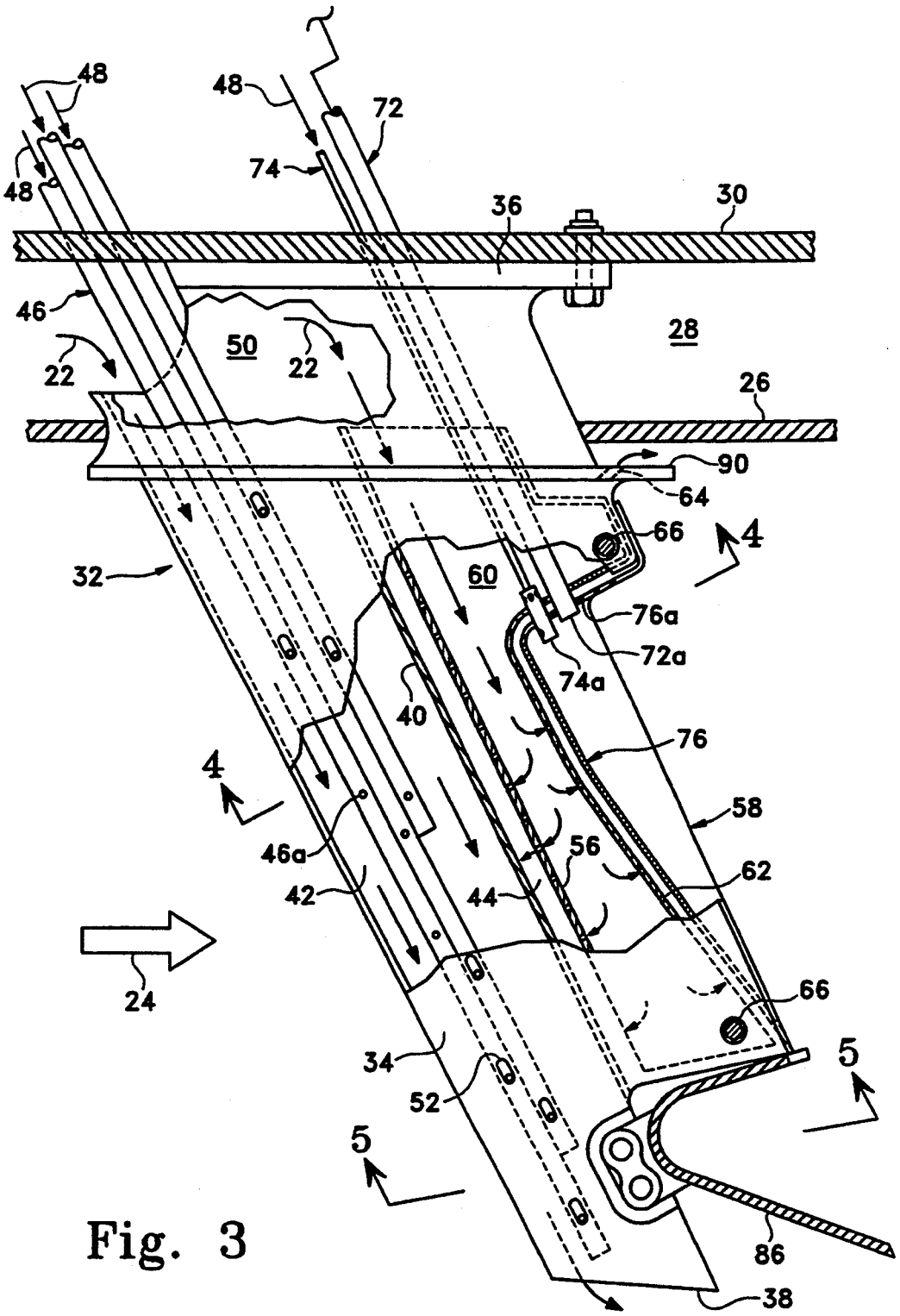
FIG. 3 is an enlarged lateral or side view of an exemplary embodiment of the cooled ignition flameholder illustrated in FIG. 1.

More specifically, FIG. 3 illustrates in more particularity an exemplary embodiment of the ignition flameholder assembly 32. The ignition flameholder 32 includes a first or forward heat shield 34 having a support end 36 at a radially outer end thereof for being conventionally mounted to the outer casing 30 by a plurality of bolts. The first heat shield 34 is longitudinally, or radially, elongate and is swept back or inclined in a downstream direction with its radially inner end 38 being suspended inside the augmenter liner 26 and disposed downstream from the support end 36.

Figure 4:
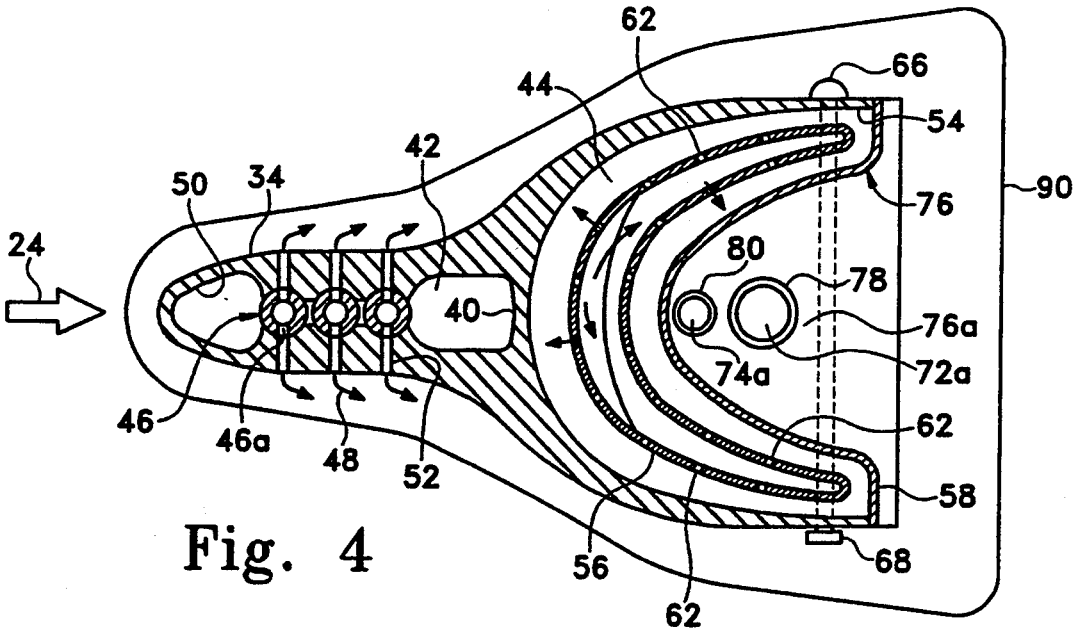
FIG. 4 is a radial, partly sectional view of the ignition flameholder illustrated in FIG. 3 and taken along line 4—4.
Figure 5:
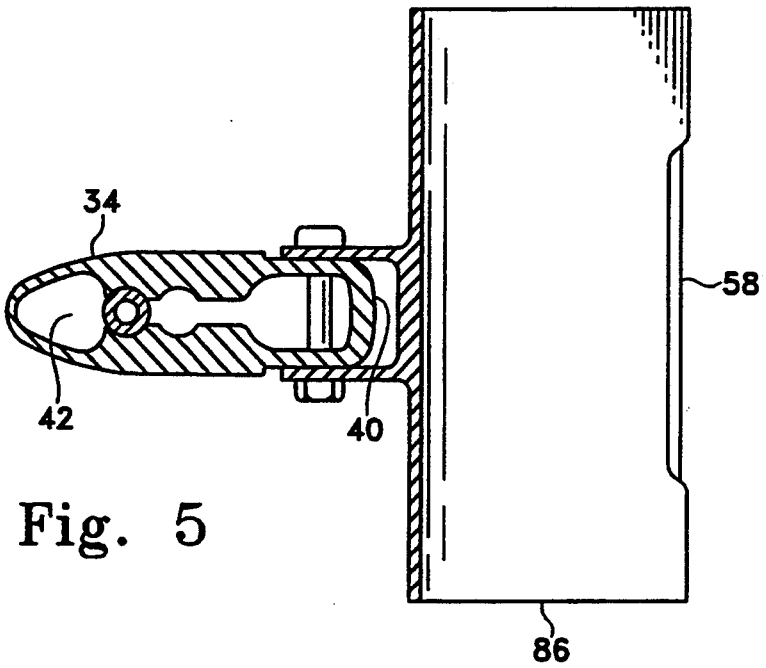
FIG. 5 is a radial, partly sectional view of the ignition flameholder illustrated in FIG. 3 and taken along line 5—5.

In an exemplary embodiment, the first heat shield is a cast member having a radially extending, imperforate septum 40 disposed centrally therein as illustrated in FIGS. 3–5 which divides the first heat shield 34 into radially elongate, generally parallel, first and second chambers 42 and 44, respectively. As illustrated most clearly in FIGS. 4 and 6, the first chamber 42 is enclosed on all four sides and extends from the top of the first heat shield 34 adjacent the support end 36 to the inner end 38 (see also FIG. 3). The first chamber 42 is configured for receiving therein a conventional fuel spraybar 46 having one or more fuel tubes or legs as conventionally known (three being shown). The fuel spraybar 46 includes a plurality of longitudinally spaced apart fuel outlets **46*a* on both lateral sides thereof as illustrated in FIGS. 3 and 4 for discharging fuel 48 from the first heat shield 34 inside the augmenter liner 26 when desired. The fuel spraybar 46 extends radially outwardly from adjacent the inner end 38 of the first heat shield 34 inside the first chamber 42 and through both the augmenter liner 26 and the outer casing 30** and is joined to a conventional fuel supply for selectively providing fuel thereto when desired.

As shown in FIGS. 3 and 4, the first heat shield 34 includes an air inlet 50 facing in an upstream direction in the bypass duct 28 for receiving a portion of the cooling air 22 therein. The air 22 is channeled by the inlet 50 radially inwardly through the first chamber 42 and is discharged from the first heat shield 34 through an outlet at the inner end 38 thereof. In this way, the upstream portion of the first heat shield 34 is cooled by the air 22 channeled through the first chamber 42 thereof. The fuel spraybar 46 is conventionally supported at its radially outer end and is therefore suspended inside the first chamber 42 and is free to expand without restraint from the first heat shield 34 itself. In this way, the relatively hot first heat shield 34 which is heated by the core gases 24 and the combustion gases in the combustion zone formed within the augmenter liner 26 is allowed to expand at a greater rate than that of the relatively cool fuel spraybar 46.

Fuel from the spraybar outlets **46*a* is discharged laterally therefrom and through the first heat shield 34 itself through a plurality of radially spaced apart fuel ports 52 which are aligned with respective ones of the fuel outlets 46*a*. As shown in FIG. 3, the fuel ports 52 are preferably radially elongated, with the fuel outlets 46*a* being initially aligned with the radially inner ends thereof so that as the first heat shield 34 is heated and expands during operation, the fuel ports 52 still provide access for discharging the fuel 48 from the fuel outlets 46*a***.

Figure 6:
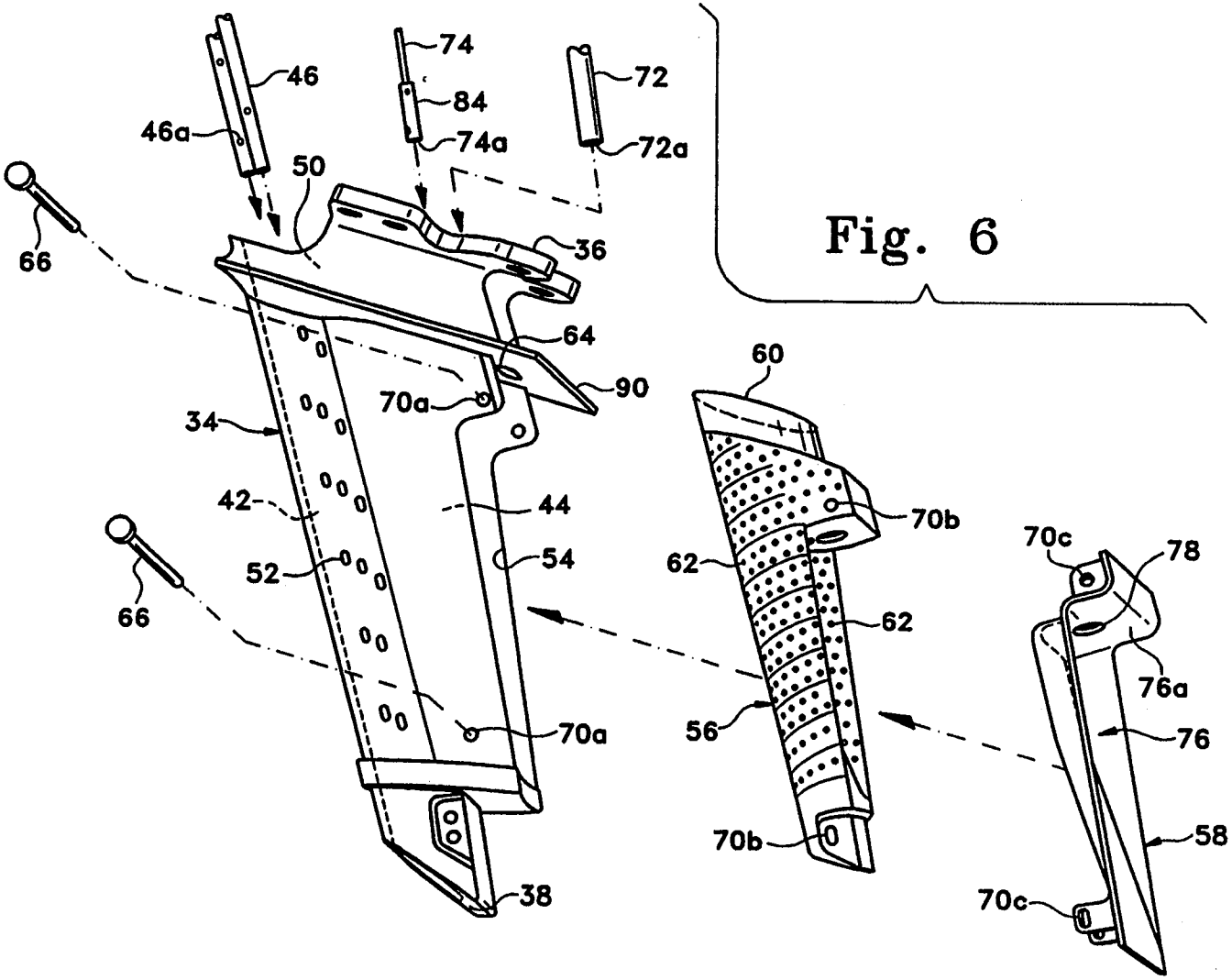
FIG. 6 is an exploded, perspective view of the ignition flameholder illustrated in FIG. 3 showing assembly of several components thereof.

The second chamber 44 of the first heat shield 34 is illustrated in more particularity in FIGS. 3, 4 and 6. The second chamber 44 is generally U-shaped in radial section and is enclosed on three sides, with an open fourth side facing in the downstream direction relative to the direction of flow of the core gases 24 to define a radially and circumferentially extending access opening 54 along the one or aft side thereof.

Disposed inside the second chamber 44 is a hollow cooling baffle 56 which may be readily positioned therein through the access opening 54. A second heat shield 58, or back plate, is removably joined to the first heat shield 34 as shown in FIGS. 3, 4, and 6 for closing the access opening 54. In the embodiment illustrated in these Figures, the first chamber 42 is disposed on an upstream end of the first heat shield 34 relative to the direction of the core gases 24 flowable thereover, and the second chamber 44 is disposed on the downstream end of the first heat shield 34. When the fuel 48 is discharged from the fuel spraybar 46 during augmenter operation, it flows downstream from the first heat shield 34 and is ignited as described hereinbelow for generating additional combustion gases for providing additional thrust. The augmenter combustion gases necessarily generate heat which is radiated upstream toward the flameholder assembly 32. The second heat shield 58, therefore, faces downstream toward the hot combustion gases for providing a thermal shield for reducing heat flux directed upstream toward the ignition flameholder 32. An aerodynamic stagnation or wake region is effected downstream of the ignition flameholder 32 having reduced velocity for providing flame holding capability and for enhancing combustion initiation and stability.

As illustrated in FIGS. 3 and 4, the baffle 56 is disposed inside the second chamber 44 to provide a predetermined clearance between the walls defining the second chamber 44 and the inside surface of the second heat shield 58. The baffle 56 has an inlet 60 as shown in more particularity in FIGS. 3 and 6, disposed at the radially outer end thereof for receiving a portion of the cooling air 22 from the common inlet 50. The cooling air 22 flows radially inwardly through the baffle 56 and is discharged through a plurality of spaced apart outlet holes 62 disposed in all sides thereof for discharging the cooling air 22 in impingement against the inside surface of the walls of the first heat shield 34 defining the second chamber 44, and the second heat shield 58 for impingement cooling thereof. In this way, the first and second heat shields 34,58 which are heated by the combustion gases may be cooled from inside by the impingement cooling air directed thereagainst from the baffle outlet holes 62.

Figure 7:
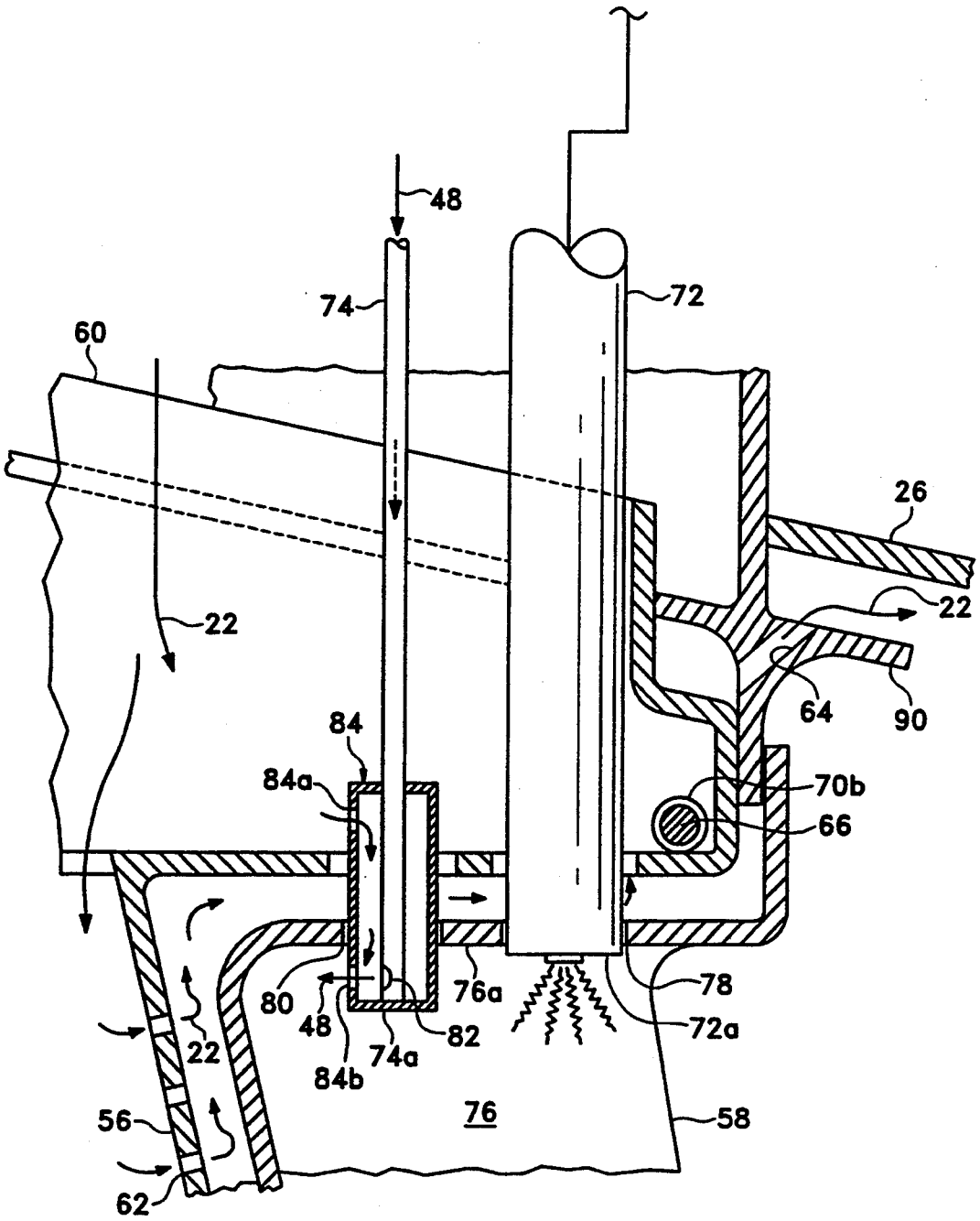
FIG. 7 is an enlarged, partly sectional side view of a pocket and step region of the ignition flameholder illustrated in FIG. 3 showing further details of a fuel injector and igniter extending therein.

As illustrated in FIGS. 3, 6, and 7, the first heat shield 34, preferably also includes a spent air outlet 64 disposed adjacent to the top support end 36 in flow communication with the second chamber 44 for discharging therefrom the cooling air 22 discharged from the baffle outlet holes 62 after impingement against the first and second heat shields 34,58. The outlet 64 is preferably disposed adjacent to and radially inwardly of the augmenter liner 26 to ensure that the spent cooling air 22 is discharged into the augmenter liner 26 adjacent its radially inner surface and away from the main combustion gases. In this way, the stability of the combustion gases is not affected by the spent cooling air 22, and additional cooling is also provided for the liner 26 to guard against hot streaks. Furthermore, in the event the second heat shield 58 is damaged during operation with a hole burned therethrough, the spent cooling air 22 may then be discharged from such burned hole for reducing further damage to the second heat shield 58.

The second chamber 44, the baffle 56, and the second heat shield 58 are all subject to different operating temperatures which must be accommodated for preventing undesirably large stresses which could decrease the useful lives thereof. Accordingly, in the preferred embodiment of the present invention, means are provided for supporting the baffle 56 in the second chamber 44 for allowing substantially unrestrained thermal expansion between the baffle 56 and the first heat shield 34 which contains the second chamber 44. In the preferred embodiment of the invention, the supporting means also supports the second heat shield 58 on the first heat shield 44 for allowing substantially unrestrained thermal expansion between the second heat shield 58 and the first heat shield 34.

More specifically, and referring to FIGS. 3, 4, and 6, a preferred embodiment of the supporting means includes two longitudinally or radially spaced apart pins 66 extending laterally through the first heat shield 34, baffle 56, and the second heat shield 58. As shown in FIG. 4, a simple washer 68 may be conventionally joined or welded to the end of each pin 66 to prevent its removal from the first heat shield 34 after final assembly. As shown in FIG. 6, the first heat shield 34, the baffle 56, and the second heat shield 58 have respective apertures 70*a,b,c* through which the respective pins 66 extend. As shown in FIG. 3, the respective apertures 70*a,b,c* are aligned together upon assembly so that a respective pin 66 may be inserted therethrough, with the washer 68 (see FIG. 4) then being joined to the pin 66 for preventing the disassembly thereof. As shown in FIG. 3, the uppermost one of the pins 66 is disposed in complementary apertures, i.e. the uppermost ones of the apertures 70*a,b,c*, for suspending the baffle 56 and the second heat shield 58 from the first heat shield 34 and restraining longitudinal or radial movement therebetween at the top pin 66. As shown in FIG. 6, the top pin 66 has a circular cross-section, with the respective apertures 70*a,b,c* also having circular cross-sections suitably larger than the outer diameter of the pin 66 for providing a suitable assembly clearance therebetween with minimal lateral movement.

However, in order to accommodate differential thermal expansion between the first heat shield 34, the baffle 56, and the second heat shield 58, the remaining, lower apertures 70*b,c* in the baffle 56 and second heat shield 58 are suitably larger in dimension than the lower pin 66 extending therethrough, and in the embodiments illustrated in FIG. 6 have a longitudinally or radially elongate racetrack-shaped configuration. The lower apertures 70*a* of the first heat shield 34 are also circular to suitably support the lower pin 66. In this way, both the first heat shield 34 and the second heat shield 58 may thermally expand more than the expansion of the relatively cold baffle 56 without restraint between these three components.

Accordingly, the ignition flameholder 32 includes a plurality of discrete components subject to different operating temperatures which are preferentially joined together for preventing or reducing restraint therebetween which would lead to undesirable low cycle fatigue thermal damage. The ignition flameholder 32 is cooled by the air 22 through both its first chamber 42 and its second chamber 44, with the impingement air discharged from the baffle holes 62 providing substantial impingement cooling of the first and second heat shields 34,58 which is subjected to the highest heat flux. The resulting assembly is therefore effectively cooled with the relatively cold air 22 without imposing undesirably large thermal stresses due to restraint caused by thermal growth mismatch.

Furthermore, since the first and second chambers 42, 44 are separated by the septum 40, the spraybar 46 and therefore the fuel therein is isolated and further removed from the hot aft end of the flameholder assembly 32 which faces the combustion zone. In the event of damage to the second heat shield 58 as discussed above, the cooling flow through the baffle 56 itself will be unaffected to ensure continuity of cooling effectiveness. The second heat shield 58 is preferably configured with a relatively close fit over the access opening 54 to minimize cooling air leakage therebetween. In this way, the cooling air within the second chamber 44 is confined to flow outwardly through the outlet 64 which provides additional protection to the augmenter liner 26 from any hot streaks associated with the flameholder itself.

As described above, the ignition flameholder 32 provides the basic function of introducing the fuel 48 through the spraybar 46 into the augmenter liner 26 in the same manner as the adjacent radial flameholders 33. However, the ignition flameholder 32 is modified in accordance with the present invention from the basic radial flameholders 33 to additionally provide ignition capability for the augmenter 16. More specifically, and referring initially to FIG. 3, a conventional igniter 72 extends from outside the casing 30, and through the support end 36 into the top portion of the second chamber 44 and has an igniter tip 72*a* conventionally effective for initiating combustion by providing suitable sparks. A fuel assist tube or injector 74 similarly extends from outside the outer casing 30 and through the support end 36 into the second chamber 44, and includes an injector tip 74*a* effective for injecting additional fuel 48 for initiating combustion.

An ignition bulb 76 in the form of a concave pocket being an integral portion of the second heat shield 58 is disposed adjacent to the second chamber 44, and in the embodiment illustrated in FIG. 3 is disposed entirely therein. The bulb 76 includes a radially inwardly facing flat step 76*a* and has a maximum depth at the step 76*a* as measured axially upstream from the aft end of the second heat shield 58, with the depth of the bulb 76 decreasing radially inwardly from the step 76*a* to a zero value where it blends with the remainder of the second heat shield 58 at its radially inner end.

As shown in FIG. 4 the bulb 74 has a generally concave radial cross section which faces downstream relative to the direction of the core gases 24 for providing a relatively large sheltered zone wherein combustion may be initiated. The step 76*a* includes first and second ports 78 and 80, respectively, which receive the igniter and injector tips 72*a*, 74*a*. As shown in FIG. 7, the first and second ports 78, 80 are made as small as possible for allowing placement of the respective igniter and injector tips 72*a*, 74*a* therein with minimal leakage of the cooling air 22 therethrough. The baffle 56 includes respective access ports illustrated in FIG. 7 for allowing passage of the igniter and injector tips 72*a*, 74*a* therethrough. The concave, aft facing size and orientation of the bulb 76 provides a sheltered zone allowing the igniter tip 72*a* to initiate combustion therein upon introduction of fuel 48 from the injector tip 74*a*.

More specifically, in the exemplary embodiment illustrated in FIGS. 4 and 7, the injector tip 74*a* is located upstream or axially forwardly of the igniter tip 72*a* and axially between the main fuel spraybar 46 and the igniter tip 72*a* for injecting the fuel 48 against the upstream or back wall of the bulb 76 well within the sheltered zone effected thereby. Other arrangements of the igniter and injector tips 72*a*, 74*a* may also be used as desired.

In a preferred embodiment of the present invention as illustrated in FIG. 7, the step 76*a* is disposed adjacent to the radially outer end of the second heat shield 58, with the bulb 76 tapering in depth from the step 76*a* radially inwardly to the radially inner end of the second heat shield 58 (see FIG. 3). In this way, the step 76*a* and the maximum depth of the bulb 76 are located relatively close to the augmenter liner 26 in the region of the highest radial temperature distribution of the core gases 24 discharged from the core engine 14 (see FIG. 1) in this exemplary embodiment. The higher temperature of the core gases 24 allows for quicker and more reliable ignition, and in some cases spontaneous or autoignition of the combustible fuel mixture within the bulb 76 for enhanced operation at low attitude operation of the engine 10. By air cooling the igniter flameholder 32 as described above, a relatively long useful life will be obtained at high gas temperatures.

As shown in FIG. 7, the fuel injector 74 may simply be a fuel conduit with an outlet port 82 at the injector tip 74*a* which preferably faces axially upstream and directly faces the axially forward or back wall of the bulb 76 toward the main fuel spraybar 46 (see also FIG. 3) for injecting the fuel 48 perpendicularly relative to the longitudinal or radial axis of the fuel injector 74 and against the back wall of the bulb 76. This improves mixing of the so injected fuel 48 in the bulb 76 with the core gases 24 therein so that available oxygen mixes with the fuel 48 to provide a combustible mixture ignitable by the igniter 72 or spontaneously at low altitude. Autoignition capability decreases as altitude increases so the igniter 72 will be used for initiating combustion at high altitude, and is preferably also used at all attitudes.

The fuel injector 74 may take any suitable form including the relatively simple injector illustrated, or may alternatively take the form of a conventional atomizing injector if desired. The simple injector 74 illustrated in FIG. 7 preferably also includes a cylindrical cooling shroud 84 fixedly joined therearound and having a plurality of air inlets 84*a* for receiving a portion of the cooling air 22 from the baffle inlet 60, with an outlet 84*b* aligned with the injector tip outlet port 82 for discharging the cooling air 22 channeled inside the shroud 84 along with the fuel 48 discharged from the outlet port 82. In this way, the injector tip 74*a* may be simply cooled to avoid coking buildup, with readily available cooling air 22 being used for cooling thereof.

As shown in FIGS. 4 and 6, since the bulb 76 in this preferred embodiment is an integral portion of the second heat shield 58 and extends axially upstream into the second chamber 44, the baffle 56 has a generally concave radial cross section being complementary with the bulb 76 for providing a substantially uniform spacing therebetween for obtaining effective impingement cooling of the backside of the bulb 76 from the air discharged from the baffle outlet holes 62. The concave configuration of the baffle 56 like the complementary bulb 76 tapers from a maximum depth near its radially outer end to a minimum depth near its radially inner end.

As illustrated in FIG. 6, the baffle 56 is concave near its inlet end 60 and tapers in depth toward its radially inner end to match the depth of the bulb 76 disposed therein. In this way, the respective apertures 70*b,c* are located radially outwardly and inwardly of the bulb 76 and the concave portion of the baffle 56 so that the pins 66 may pass therethrough without entry through the sheltered zone defined by the bulb 76.

As shown in FIGS. 2, 3, and 5, the ignition flameholder 32 preferably also includes a circumferential-segment gutter 86 suitably joined to the radially inner end of the first heat shield 34 by a pair of mounting pins. The gutter 86 is generally V-shaped in transverse section and has an open end facing in the downstream direction for providing crossfiring to the radial flameholders 33. As shown in FIG. 2, the gutters 86 for the ignition flameholder 32 and the radial flameholders 33 are identical in configuration and collectively form a segmented annular ring having flameholder capability. The segmented gutters 86 allow each gutter 86 to move freely with its respective first heat shield 34 without undesirable restraint from adjacent components.

Also as shown in FIG. 2, the ignition flameholder 32 is substantially similar in configuration with the radial flameholders 33 since they all have similar fuel spraybars 46 (see FIG. 3) for providing main and pilot fuel as desired in a conventionally known manner, with the respective second heat shield 58 providing radial flameholder capability, with the gutters 86 providing circumferential flameholder capability. Whereas the aft heat shields of the radial flameholders 33 are preferably flat, the second heat shield 58 of the ignition flameholder 32 includes the ignition bulb 76 for providing a more effective sheltered zone in which combustion may be initiated using the additional fuel from the fuel injector 74, either by autoignition or preferably by using the igniter 72. As shown in FIG. 2, the circumferential width of the second heat shield 58 may be made suitably larger than the circumferential width of the heat shields of the adjacent radial flameholders 33 for providing a suitably large sheltered zone in the ignition bulb 76 for obtaining effective ignition of the combustible mixture therein. However, the resulting ignition flameholder 32 is a relatively compact assembly having relatively low pressure loss which provides both flameholding capability as well as effecting combustion ignition. The cooling arrangement for the ignition flameholder 32 uses relatively cold fan bypass air to provide effective cooling of the components thereof without undesirable low cycle fatigue therein.

Figure 10:
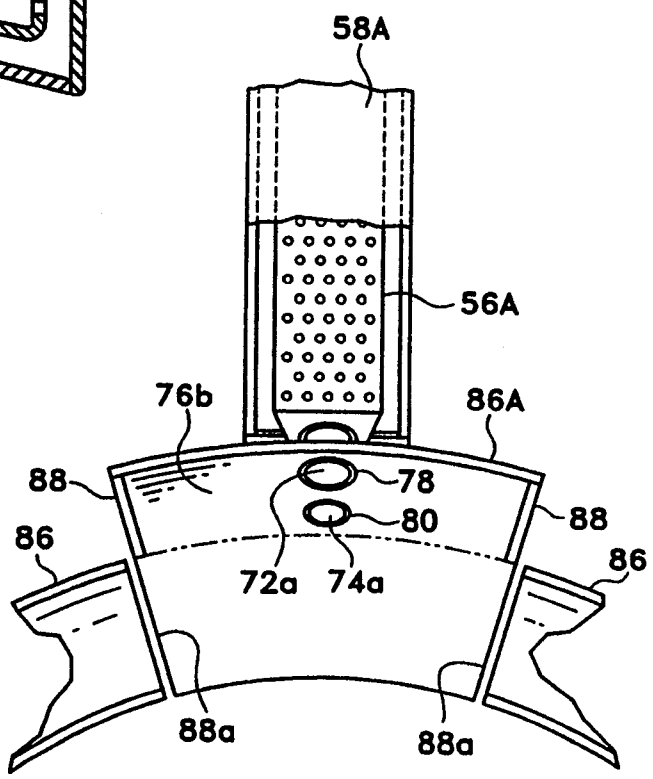
FIG. 10 is an upstream facing partly sectional view of a portion of the ignition flameholder illustrated in FIG. 8 and taken along line 10—10.
Figure 9:
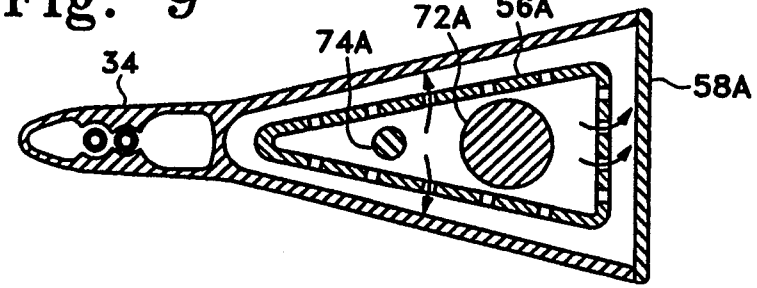
FIG. 9 is a radial sectional view of the ignition flameholder illustrated in FIG. 8 and taken along line 9—9.
Figure 8:
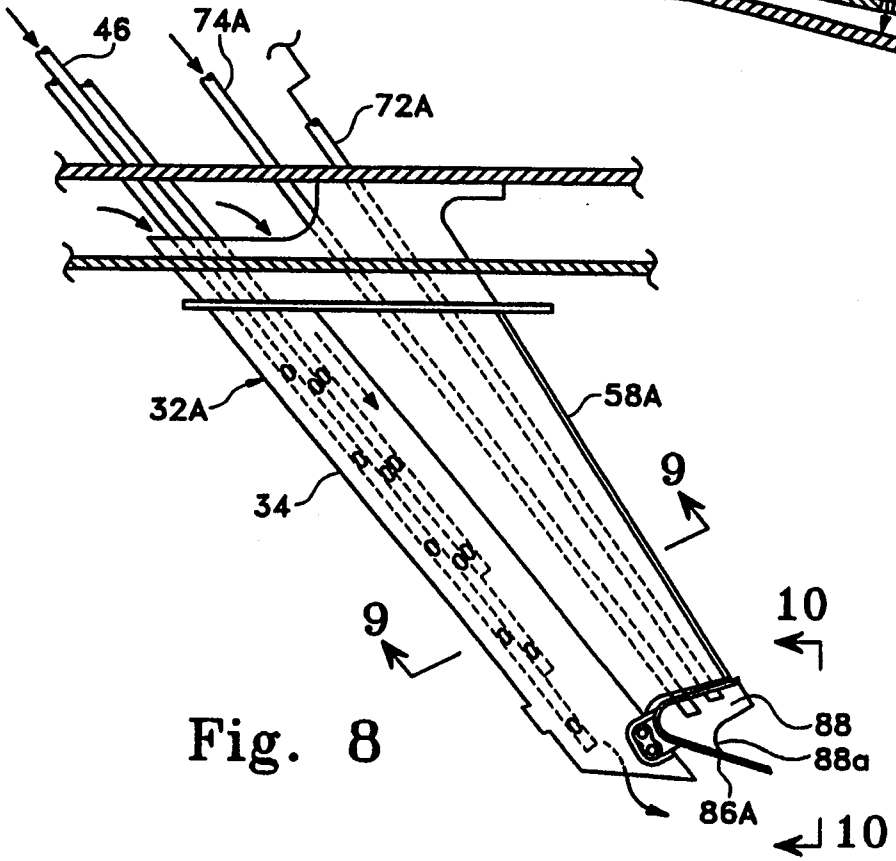
FIG. 8 is a lateral or side view of an ignition flameholder in accordance with a second embodiment of the present invention having a circumferentially extending gutter segment receiving the fuel injector and igniter.

Illustrated in FIGS. 8–10 is an alternate embodiment of the ignition flameholder designated 32A which is similar to the ignition flameholder 32 except that the second heat shield 58A does not include the ignition bulb 76 but instead is substantially flat. The ignition bulb in this embodiment is in the form of a V-shaped circumferential-segment gutter 86A extending circumferentially or laterally outwardly from opposite sides of the second heat shield 58A at the radially inner end thereof. As shown in FIG. 10, the ignition bulb or gutter 86A is suitably larger or radially taller than the adjacent gutters 86 for providing a relatively large sheltered zone. As shown in FIGS. 8 and 10, the ignition gutter 86A includes a pair of side panels 88 at circumferentially opposite ends thereof for restraining cross-flow circumferentially across the gutter 86A for enhancing the sheltered zone therein. The side panels 88 include generally V-shaped cut outs 88*a* therein which are complementary in configuration with the adjacent circumferential flameholder gutters 86 for allowing flow communication therebetween and spreading of the combustion flame.

The radially outer leg of the gutter 86A defines the radially inwardly facing step 76*b* having similar first and second ports 78, 80 receiving the igniter and injector tips 72*a*, 74*a*. Both the igniter 72A and the fuel injector 74A accordingly extend completely radially through the baffle 56A to reach the gutter 86A. In this way, the second heat shield 58A provides radial flameholder capability identical to that of the adjacent heat shields of the radial flameholders 33, with the enlarged gutter 86A providing the ignition bulb sheltered zone in which combustion may be initiated using fuel from the injector tip 74*a* and spark from the igniter tip 72*a*.

As illustrated in FIGS. 2–4 and 6, the flameholder 32 preferably also includes a relatively thin wing 90 fixedly integrally joined to the first heat shield 34 at the support end 36 thereof. The wing 90 preferably extends around the full perimeter of the first heat shield 34 with an increasing lateral projection from the upstream to downstream ends of the first heat shield 34. As shown in FIG. 4, the lateral projection of the wing 90 increases in magnitude and is greatest near the aft or downstream end of the first heat shield 34. The wing 90 preferably extends a suitable distance downstream from the aft end of the first heat shield 34 and overhangs the second heat shield 58 to obstruct gas flow radially downwardly over the wing 90 along the first and second heat shields 34, 58. As shown in FIG. 3, the wing 90 is disposed adjacent to the inner surface of the augmenter liner 26 and provides a barrier both for the cooling air 22 discharged from the outlet 64 as well as for the portion of the core gases 24 flowing adjacent to the inner surface of the augmenter liner 26. The wing 90 therefore promotes flame stability downstream of the second heat shield 58 by reducing radially inwardly directed secondary flow.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. An ignition flameholder for a gas turbine engine comprising:

a radially extending first heat shield including a support end for being mounted to an annular casing; an elongate, enclosed, first chamber; an elongate, second chamber separated from said first chamber by a septum and having an access opening along one side thereof;

a fuel spraybar disposed in said first chamber for discharging fuel from said first heat shield;

a hollow baffle disposed inside said second chamber and having an inlet at one end thereof for receiving cooling air, and a plurality of outlet holes therein for discharging said cooling air;

a radially extending second heat shield joined to said first heat shield for closing said access opening, and disposed adjacent to said outlet holes for being impingement cooled thereby;

an igniter extending in said second chamber and having an igniter tip for initiating combustion;

a fuel injector extending in said second chamber and having an injector tip for injecting fuel;

an ignition bulb disposed adjacent to said second chamber and having a pair of ports for receiving respective ones of said igniter and injector tips, said ignition bulb being sized for providing a sheltered zone therein for allowing said igniter tip to initiate combustion therein.

2. An ignition flameholder according to claim 1 wherein:

said ignition bulb is in the form of a concave pocket and is an integral portion of said second heat shield; and said bulb includes a radially inwardly facing step having said ports receiving said igniter and injector tips said bulb having a maximum depth at said step, and decreasing in depth radially inwardly from said step.

3. An ignition flameholder according to claim 2 wherein said baffle has a generally concave cross section being complementary with said bulb for providing a substantially uniform spacing therebetween for impingement cooling said bulb from air discharged from said outlet holes.

4. An ignition flameholder according to claim 3 wherein said step is disposed adjacent to a radially outer end of said second heat shield, and said bulb is tapered in depth from said step to a radially inner end of said second heat shield.

5. An ignition flameholder according to claim 3 wherein said injector tip includes an outlet port directly facing said bulb toward said fuel spraybar for injecting fuel perpendicularly to a longitudinal axis of said fuel injector.

6. An ignition flameholder according to claim 5 wherein said injector tip includes a cylindrical cooling shroud therearound with a plurality of inlets for receiving cooling air, and an outlet aligned with said injector tip outlet port for discharging said cooling air along with fuel from said outlet port.

7. An ignition flameholder according to claim 3 wherein said injector tip is located axially forwardly of said igniter tip and between said fuel spraybar and said igniter tip.

8. An ignition flameholder according to claim 1 wherein:

said second heat shield is substantially flat;

said ignition bulb is in the form of a V-shaped gutter extending circumferentially outwardly from opposite sides of said second heat shield at a radially inner end thereof, and having a radially inwardly facing step with said ports receiving said igniter and injector tips; and said gutter includes a pair of side panels at circumferentially opposite ends thereof for restraining cross flow circumferentially across said gutter.

9. An ignition flameholder according to claim 8 wherein said side panels include generally V-shaped cut outs therein for flow communication with complementary adjacent circumferential flameholder gutters.

10. An ignition flameholder according to claim 8 wherein said igniter and said fuel injector extend radially through said baffle.

* * * * *